United States Patent [19]

Warnod

[11] 4,000,715

[45] Jan. 4, 1977

[54] ACOUSTIC ALARM DEVICE WITH SOUND ATTENUATOR

[75] Inventor: Bertrand A. Warnod, Courbevoie, France

[73] Assignee: Klaxon, France

[22] Filed: May 29, 1975

[21] Appl. No.: 583,542

[30] Foreign Application Priority Data

May 31, 1974 France ..... 74.18951

[52] U.S. Cl. ..... 116/137 R; 340/391

[51] Int. Cl.[2] ..... G10K 9/22; G10K 1/062

[58] Field of Search ..... 116/137 R, 142, 143, 116/145, 172, 140, 124 R; 46/174, 182; 340/388, 391

[56] References Cited

UNITED STATES PATENTS

| | | | |
|---|---|---|---|
| 758,363 | 4/1904 | Hutchison | 340/388 |
| 2,153,500 | 4/1939 | Eaves | 116/137 R X |
| 3,041,601 | 6/1962 | Wetzel | 340/388 X |
| 3,094,972 | 6/1963 | Leavenworth | 116/137 R X |
| 3,432,849 | 3/1969 | Earling | 340/388 |
| 3,866,203 | 2/1975 | Berns | 340/388 X |

*Primary Examiner*—Richard C. Queisser
*Assistant Examiner*—Daniel M. Yasich
*Attorney, Agent, or Firm*—Fleit & Jacobson

[57] ABSTRACT

An electromagnetic acoustic alarm device including a casing formed in part by a bell-shaped wall which defines together with a membrane secured to the casing by means of the bell-shaped wall a chamber, the front portion of the wall provided with at least one opening and a rotatable external plate of the same configuration as the wall front portion having at least one opening for registration to a selected extent with the wall opening so as to adjustably attenuate the high frequency sound component of the device.

1 Claim, 7 Drawing Figures

Fig-1
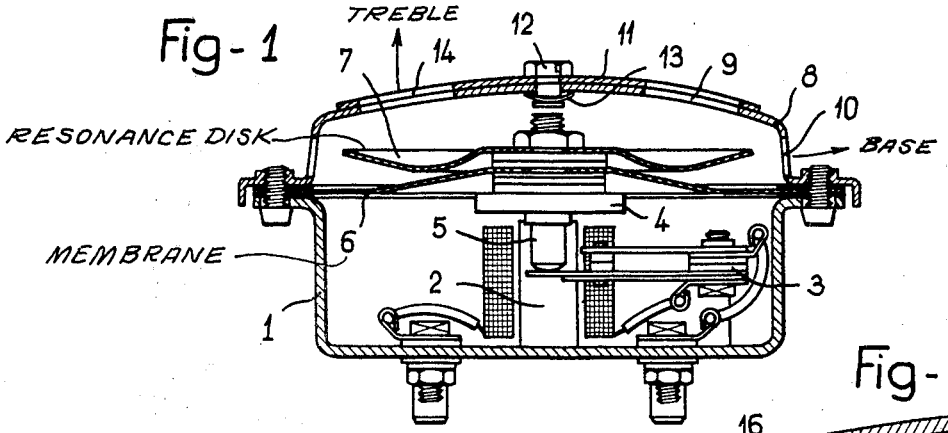
Fig-4
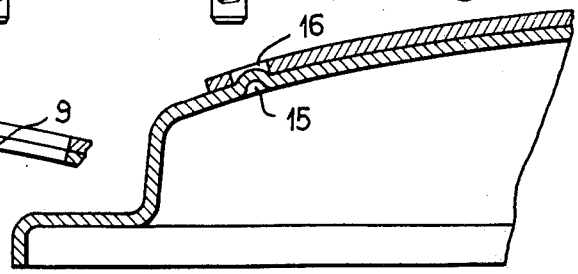
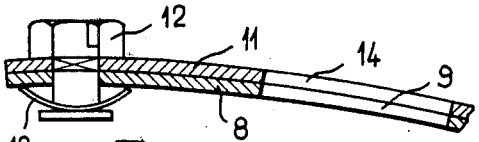
Fig-3
Fig-2
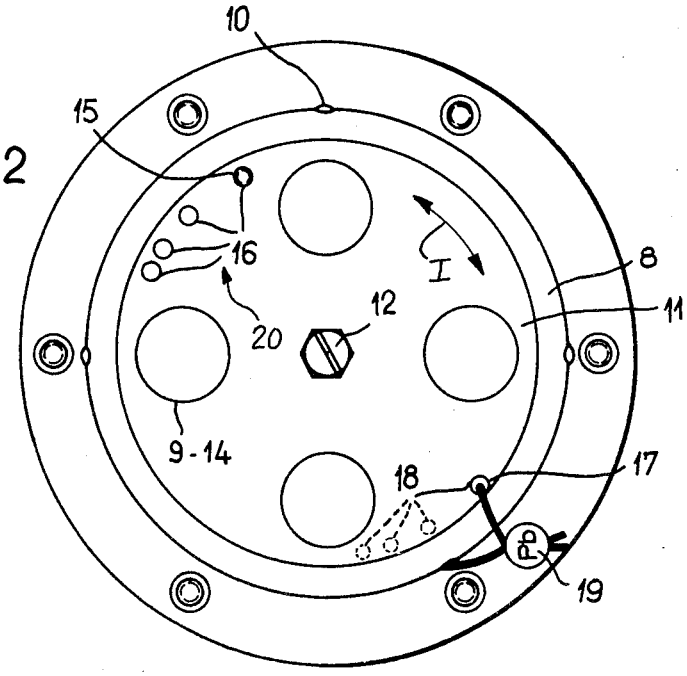

Fig - 5
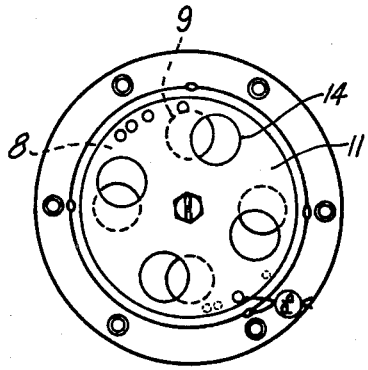
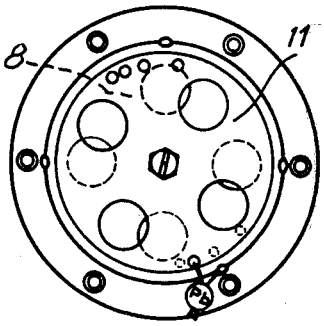
Fig - 6
Fig - 7
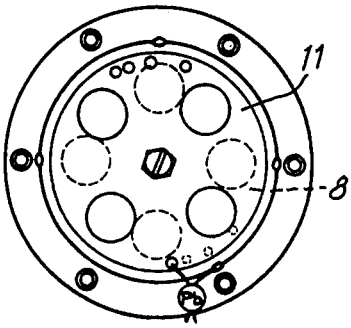

ACOUSTIC ALARM DEVICE WITH SOUND ATTENUATOR

The present invention relates in general to acoustic alarm devices and more particularly to an improved acoustic alarm device such as a hooter but provided with an acoustic or sound attenuator.

Acoustic alarm devices such as hooters or electromagnetic disk devices or the like deliver as a rule a power output characterized by a non adjustable harmonic spectral distribution, in contast, inter alia, with certain known electronic acoustic devices.

It is the primary object of the present invention to avoid this inconvenience by providing an acoustic alarm device eqiupped with an acoustic or sound attentuator capable, in the case of a non-electronic device, for instance, to deliver a variable acoustic power output, more particularly in the treble spectrum.

Conventionally, the function of acoustic alarm devices is, when actuated, to deliver a predetermined information concerning for example:

- an abnormal or faulty operation of a machine or plant;
- an imminent explosion of a blast mine on a building or other site;
- an order for immediate evacuation of premises or other spaces in case of fire, etc.

To be efficient an apparatus of this type must be heard in all the cases of actual service contemplated, irrespective of the position of the apparatus and the place from which it is heard, and finally, whatever the ambient noise level may be. To this end, the sound signal must be enough clear and powerful to emerge from such ambient noise.

Consequently, only powerful hooters capable of delivering high-pitch harmonics must be provided, so that treble sounds in the most efficient range, i.e. between 1,000 and 4,000 Hertz, emerge more sharply from ambient noise in comparison with bass sounds. On the other hand, it is obvious that apparatus of this type when used in rooms where the noise level is usually moderate, for example in offices, stores, schools, etc., are excessively powerful and their sound spectrum comprising a considerable range of treble harmonics is even likely to have traumatic consequences on the personnel. Therefore, there is a demand for acoustic alarm apparatus of which the sound output can be adjusted, especially in the treble range, in order to adapt this output to each specific case, in order to obtain a satisfactory efficiency without any excess.

According to this invention, the device for producing a sound signal having a variable spectral power output is an alarm hooter of the resonance-disk electromagnetic type, characterized by a high power output in the treble range, and that it is coupled with an adjustable attenuator whereby this treble power output can be reduced at will without altering the bass sound output and more particularly the fundamental frequency.

The attenuator according to this invention comprises a sound generating chamber communicating through adjustable openings with the ambient medium in which the alarm sound is to be propagated. This chamber is bounded by the membrane of the device and by a rigid bell-shaped wall having a peripheral flange for securing the membrane to the case of the device by means of screws, or rivets, or by crimping, said bell-shaped wall comprising on its front face a plurality of openings registering with the resonance disk mounted within said chamber. A shutter plate of same curvature as the bottom of said bell-shaped wall is fitted against the outer surface of said wall and either comprises likewise openings of which the shape and size correspond to those of said walls or has a configuration matching the wall openings, whereby, by moving said plate, the wall openings can be opened or closed gradually, thus releasing more or less sound power in the treble range which is generated by virtue of the vibration of said resonance disk. Other openings formed through the outer peripheral wall portion substantially perpendicular to said peripheral flange are kept free of any shutter means so that the bass sounds emitted by the membrane can pass freely therethrough; these openings allow only a very small fraction of the treble to be emitted therethrough from the resonance disk, the latter having well known directional properties. Detent positioning or indexing means are also provided on the attenuator for easily determining, by varying the passage area of the front openings, the attenuation of the treble sounds.

By way of example and in order to afford a clearer understanding of the efficiency of the device of this invention, the following table illustrates the total sound power output (in decibels) of the apparatus, as well as the power output measured for each sound radiation of the acoustic spectrum. These results are obtained with different degrees of opening of the front openings of the attenuator.

| | SOUND LEVEL IN DECIBELS | | |
|---|---|---|---|
| | Maximum aperture | Average aperture | Fully-closed opening |
| Total level | 115 | 103 | 85 |
| Frequency of each sound radiation (Hertz): | | | |
| 480 | 85 | 84 | 84 |
| 960 | 78 | 78 | 76 |
| 1,440 | 69 | 67 | 64 |
| 1,920 | 79 | 75 | 69 |
| 2,880 | 101 | 93 | 72 |
| 3,360 | 113,5 | 102 | 69 |
| 3,840 | 100 | 79 | 60 |

From the above table, it is clearly apparent that when the front openings are closed, the bass sounds remain substantially at the same level whereas the power level of the treble is strongly reduced.

The movement of the shutter plate adjacent the wall permits of closing very gradually the front openings; however, this closing movement may be set in predetermined positions giving the desired or well-defined acoustic properties. Thus, for instance:

| | | |
|---|---|---|
| - Maximum aperture position: | 100/100 | About 115 decibels; |
| - Wide-open position: | 50/100 | Weakening of about 10 decibels; |
| - Small aperture position: | 10/100 | Weakening of about 20 decibels; |
| - Fully closed position: | 0/100 | Weakening of about 30 decibels. |

A lead stamp or seal may be applied to the attenuator in order to lock the shutter plate in the selected position and prevent any tampering with the present adjustment.

In order to afford a clearer understanding of this invention, a typical form of embodiment thereof will now be described in detail with reference to the attached drawing, in which:

FIG. 1 is a diagrammatic sectional view of a resonance disk type electromagnetic acoustic alarm device incorporating the attenuator according to this invention;

FIG. 2 is a front view of the attenuator, with the openings thereof fully closed;

FIGS. 3 and 4 illustrate in fragmentary radial section and on a larger scale details of the shutter plate driving means and of the means for detent-positioning same on the bell-shaped wall of the attenuator;

FIGS. 5 and 6 are front views of the attenuator, in which the openings are partially closed, and FIG. 7 is a front view of the same attenuator with the front openings fully closed.

As illustrated in FIG. 1, the electromagnetic resonance-disk acoustic alarm device comprises substantially and as already known per se a cup-shaped case 1, a contact-breaker 3, a yoke 4 mechanically connected by means of a shaft 5 to a membrane 6 and a resonance disk 7. The membrane 6 is clamped to the case 1 by means of a peripheral flange formed on a bell-shaped rigid wall 8 forming the attenuator chamber and comprising on the one hand a plurality of openings 9 registering with said resonance disk 7 and another series of openings 10 formed through a substantially perpendicular portion of wall 8. An external perforated plate 11 having a curvature matching that of said wall 8 is secured thereto at its centre by means of a rivet 12 (see FIG. 3), a spring washer 13 being provided for safely retaining said rivet 12 and plate 11 against the wall 8. Preferably, the rivet 12 has a slotted hexagonal head so that it can be rotated by means of a screwdriver or spanner, and under its head this rivet comprises a square neck fitting in a hole of same configuration formed centrally of said external plate 11, so that when the head of rivet 12 is rotated it carries along the plate 11.

The openings 14 formed in plate 11, when positioned more or less in front of the openings 9 formed in wall 8, permit of opening or closing the chamber of the attenuator in which the sounds are generated. Thus, the acute sounds emitted by the disk 7 are more or less transmitted to the external medium according to the passage area of said openings, which is left free. On the other hand, the bass sound generated by the vibrating membrane can escape freely through the lateral openings 10 formed in the side portion of the bell-shaped wall 8, i.e. perpendicularly to the disk 7.

FIG. 2 illustrates the attenuator seen in front view, in the position corresponding to the maximum treble output (maximum opening), a detent-positioning reference or indexing means being provided for resiliently retaining the movable plate 11 in the desired or preset position in which it uncovers more or less the front openings 9.

FIG. 4 illustrates on a larger section the principle on which this detent-positioning reference or indexing means designated generally in FIG. 2 by the numeral 20, is based; a part-spherical impression 15 is formed in wall 8 and adapted to engage one of a plurality of (in this example four) holes 16 formed in plate 11 and corresponding to four predetermined adjustment or preset positions.

FIG. 5 illustrates the shutter plate 11 in one selected rotary position wherein the plate openings 14 partially overlap the wall opening 9. FIG. 6 is a view similar to FIG. 5 but with the plate 11 shown in another selected rotary position with less overlap between the openings 9, 14. Fig. 7 illustrates the plate 11 in still another selected rotary position with the plate 11 completely covering and closing the wall openings 9.

To avoid any undesired or untimely misadjustment, the plate 11 may be sealed in the selected position. To this end, in each position a small orifice 17 formed in the plate 11 corresponds to one of the four small orifices 18 formed through the wall 8 so that a sealing wire 19 can be inserted through the aligned orifices and also through one of the lateral orifices 10 of wall 8.

Although a specific form of embodiment of this invention has been described hereinabove and illustrated in the accompanying drawing, it will readily occur to those skilled in the art that various modifications and changes may be brought thereto without departing from the scope of the invention as set forth in the appended claims.

What I claim is:

1. An electromagnetic acoustic alarm device of the resonance disk type having a membrane comprising, in combination, a case, a bell-shaped rigid wall having a front portion and a side case in enclosing relationship with the membrane and the resonance disk with the membrane and said bell-shaped wall defining a chamber, said wall front portion having at least one opening, a shutter plate of a configuration matching that of said wall front portion rotatably mounted in overlying relationship with the outer surface of said wall front portion, said shutter plate having at least one opening and being movable between a plurality of selected rotary positions to position said shutter plate opening in uncovering relationship with said wall opening to a selected extent and a covering position with said wall front portion opening with respect to detent-positioning means on the shutter plate to thereby adjustably attenuate the treble sounds generated by the resonance disk, said detent-positioning means having coacting means on said shutter plate and said wall front portion for indexing the selected rotary position of said shutter plate.

* * * * *